US006299097B1

(12) United States Patent
Bird et al.

(10) Patent No.: US 6,299,097 B1
(45) Date of Patent: Oct. 9, 2001

(54) ANTI-WHIP FIBER CUTTER

(75) Inventors: Lindwood A. Bird; Chester H. H. Chang; Brian L. Green; Gilbert B. Wallace, Jr., all of Wilmington; Johnnie E. Watson, Hampstead, all of NC (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/467,757

(22) Filed: Dec. 20, 1999

(51) Int. Cl.[7] ..... B65H 54/71; B65H 57/00

(52) U.S. Cl. ..... 242/487.6; 242/157 R; 242/487.9; 242/488; 242/920

(58) Field of Search ..... 242/157 R, 487.6, 242/487.9, 488, 487.1, 920

(56) References Cited

U.S. PATENT DOCUMENTS

| | | | | |
|---|---|---|---|---|
| 2,797,053 | * | 6/1957 | Furst | 242/487.1 |
| 2,810,436 | * | 10/1957 | Cheshko | 242/487.9 |
| 3,992,967 | | 11/1976 | Fram | 83/347 |
| 4,373,650 | | 2/1983 | Gay | 225/97 |
| 4,569,264 | | 2/1986 | Van Doorn et al. | 83/100 |
| 4,573,617 | | 3/1986 | Durkow | 225/96 |
| 4,621,754 | | 11/1986 | Long et al. | 225/96 |
| 5,046,252 | | 9/1991 | Ayuta et al. | 30/258 |
| 5,092,207 | | 3/1992 | Kikuchi et al. | 83/116 |
| 5,438,860 | | 8/1995 | Kawai et al. | 73/7 |
| 5,549,254 | * | 8/1996 | Menegatto | 242/487.9 X |
| 5,558,287 | | 9/1996 | Darsey et al. | 242/18 R |
| 5,709,138 | | 1/1998 | Rimer | 83/18 |
| 5,820,046 | * | 10/1998 | Nieminen | 242/128 X |
| 5,873,291 | | 2/1999 | Sand | 83/260 |
| 5,964,431 | | 10/1999 | Chang | 242/615.3 |

* cited by examiner

*Primary Examiner*—Michael R. Mansen
(74) *Attorney, Agent, or Firm*—Timothy R. Krogh

(57) ABSTRACT

The invention includes an optical waveguide whipping end cutting apparatus. The apparatus includes an active cutting element. The element is positioned to cut a segment from a whipping end of an optical fiber, while the fiber is being wound onto a rotating spool. This apparatus will prevent fiber whip. The invention also includes a method of cutting a whipping end from an optical fiber. The method includes removing a segment of the end of the fiber with an active cutting element. A method of cutting an optical fiber while winding the fiber onto a storage spool is further discussed. The fiber has a whipping end and a wound segment. The method includes separating the whipping end of the fiber from the wound segment with an active cutting element. Furthermore, the invention includes a method of reducing fiber whip damage to fiber wound on a spool. This includes engaging an active cutting element on the fiber being wound onto the spool, and removing a whipping end from the fiber.

18 Claims, 4 Drawing Sheets

ANTI-WHIP FIBER CUTTER

BACKGROUND OF THE INVENTION

1. Field of Invention

The invention relates generally to the field of an optical fiber (hereinafter "fiber"). In particular, the invention relates to removing a whipping end from a fiber being wound onto a spool.

2. Technical Background

The use of fiber in the telecommunications industry to transmit data and other types of information is becoming the industry standard. Typically the fiber is coated and wound onto a spool. This is for ease of handling and shipping fiber to a customer.

During the process of winding the fiber onto a spool, the fiber may break or be cut. This break will generate a loose end of fiber, commonly known as a tail or a whip end. Unless properly treated, this end can flail and strike the fiber already on the spool and cause damage. The action of the flailing whip end of the fiber impacting the wound fiber is commonly referred to as whipping. Whipping is a very serious problem as it can damage fiber many layers deep on the spool. The whip end can cause significant and irreversible damage to many layers of fiber. This damage may result in breaks in downstream manufacturing processes, during the fiber cabling process, or even worse, in the field after the fiber is installed in a telecommunications network system.

One particular type of whip damage is "continuous whip." Continuous whip is potentially repetitive impact of the tail upon the fiber on the spool as the spool rotates to a stop. As the tail moves with the spool, the loose end may wrap around nearby objects. As the fiber unwraps, it flails about and can strike the fiber already wound on the spool. This can cause irreversible damage to the wound fiber that significantly degrades the strength of the fiber. The damage can range from punctures in the coating layers to abrasions on the glass portion of the fiber.

Prior responses to minimize continuous whip damage have included the use of guards that completely or nearly completely surround the takeup spool. However, the use of a guard has certain size and space limitations. The use of this type of guard is also prohibited by the need to thread new fiber through the guard.

SUMMARY OF THE INVENTION

One aspect of the present invention is a fiber whipping end cutting apparatus. The apparatus includes an active cutting element. The element is positioned to cut a segment from an end of an optical fiber, while the fiber is being wound onto a rotating spool.

In another aspect, the present invention includes a method of cutting a whipping end from an optical fiber. The method includes removing a segment of the end of the fiber with an active cutting element.

A further aspect of the invention includes a method of cutting an optical fiber while winding the fiber onto a shipping or storage spool. The fiber has a whipping end and a wound segment. The method includes separating the whipping end of the fiber from the wound segment with an active cutting element.

Yet an additional aspect of the invention is a method of reducing fiber whip damage to fiber wound onto a spool. The method includes engaging an active cutting element on a fiber being wound on a spool, and removing a loose end from the fiber in a manner that reduces fiber whip damage to the fiber already wound onto the spool.

The invention has the advantage of preventing whip damage to the fiber wound onto the spool. The invention also has the advantage of protecting the fiber from surface damage and pitting. The invention has the further advantage of being free from size and space requirements. The invention has the advantage of removing the offending fiber whip end. Furthermore, the invention has at least the additional advantage that the cutting element is not dependent on movement of the fiber.

Additional features and advantages of the invention will be set forth in the detailed description which follows, and in part will be readily apparent to those skilled in the art from the description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operation of the invention.

DETAILED DESCRIPTION OF THE PREFERRED EMBODIMENTS

Reference will now be made in detail to the present preferred embodiments of the invention, examples of which is illustrated in the accompanying drawings. Wherever possible, the same or like reference numbers will be used throughout the drawings to refer to the same or like parts.

Figure 1:
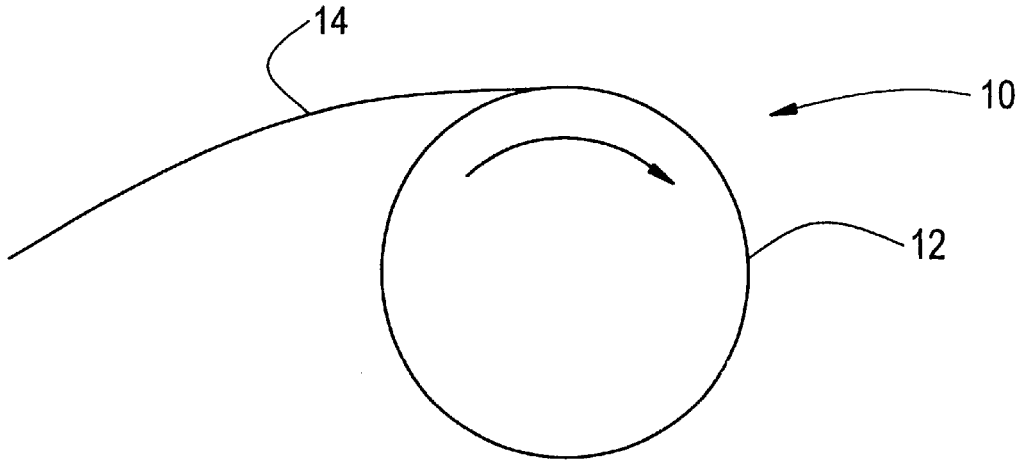
FIG. 1 PRIOR ART
FIGS. 1–3 are schematic views of the prior art.

Now referring to FIG. 1 generally designated by reference numeral 10 is a fiber 12 in the form of a fiber being wound on a spool. The fiber 12 includes a whipping end 14. The whipping end 14 is also commonly referred to as a flailing end, a loose end, a whip end, or a tail. In the course of winding the fiber 12 onto a spool, it is the whipping end 14 that can cause the aforementioned damage from continuous whip. As the spool rotates the whipping end 14 can periodically come into contact with the fiber 12 wound on the spool. This contact can cause defects such as surface damage or pitting to the wound fiber 12 or breakage of the fiber 12 already wound on the spool. The defects are not limited to only those cited.

Figure 2:
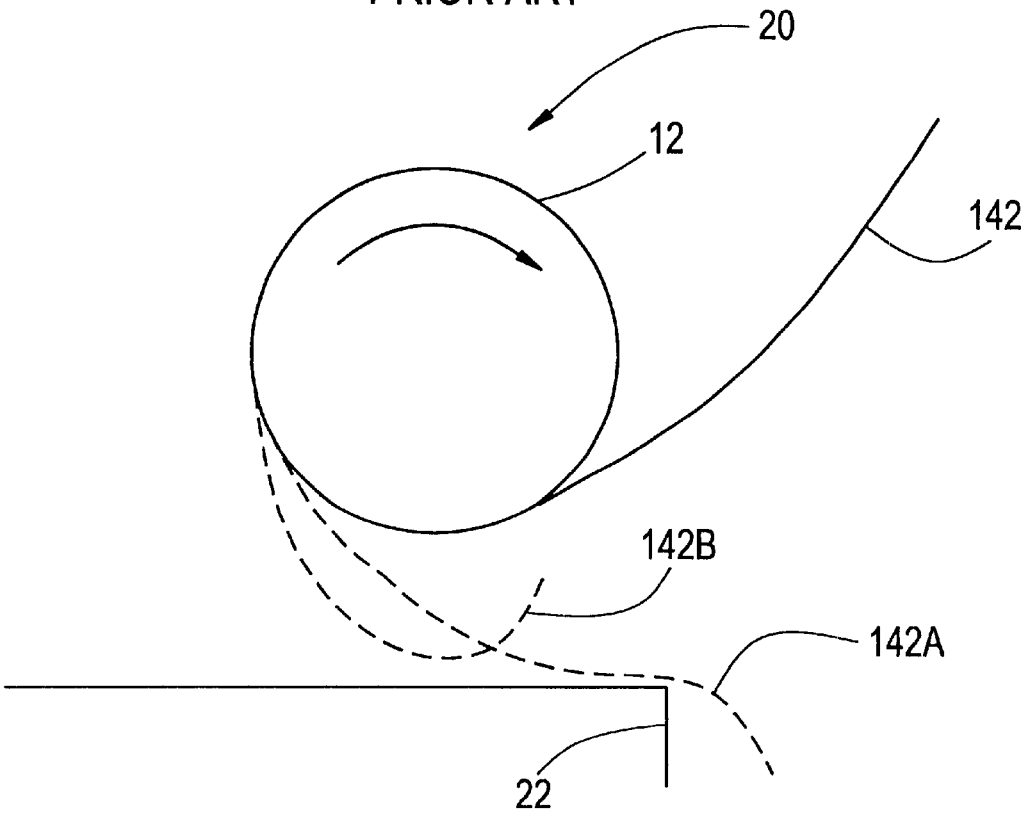
FIG. 2 PRIOR ART

The above mentioned whip damage is typically caused by the whipping end 14 coming in contact with a surface and then coming in contact with the wound fiber, as shown in FIG. 2. In FIG. 2, the whipping end 142 of the fiber 12 comes in contact with a surface 22. The surface 22 can be any suitable surface in the winding area of the production of a fiber. Examples of such surface may be supports for a winding station, a safety enclosure, or a table.

As the fiber 12 rotates, the whipping end 142 will contact the surface 22, as designated by reference numeral 142A.

Figure 3:
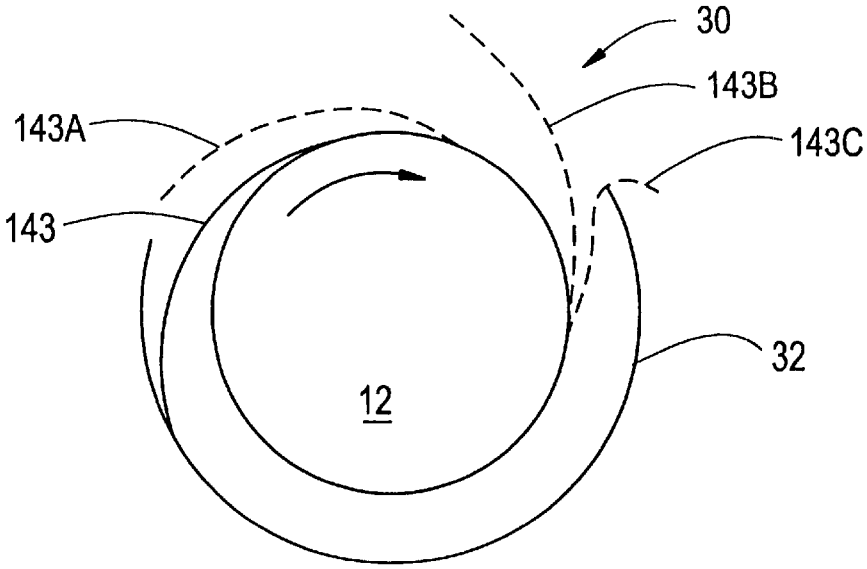
FIG. 3 PRIOR ART

This will cause the whipping end 142 to become deformed, as shown with reference numeral 142B, and often causes the tip of the whipping end 142 to strike the spool at a relatively high velocity, sometimes, causing damage to many layers of fiber already wound on the spool. A nonexhaustive list of whipping end deformations include twisting of the whipping end, bending of the whipping end, kinking of the whipping end, and intertwining of the whipping end Another example of this is shown in FIG. 3, designated by reference numeral 30. As the fiber 12 rotates, the whipping end 143 of the fiber 12 can come in contact with a guide/guard 32 disposed around the fiber 12.

The guide 32 may also be known as a fiber guide, spool guard, fiber guard, or any other like term. Examples of the guide 32 can be found in U.S. Pat. No. 5,964,431 and U.S. patent application Ser. No. 09/090748 filed Jun. 4, 1998. The aforementioned U.S. patent and U.S. patent application, as well as any parent application, are incorporated herein by reference as though fully set forth in their entirety.

As designated by reference numerals 143A–143C, the whipping end 143 of the fiber 12 may come in contact with the guide 32. This can also cause the whipping end 143 to deform and whip into the fiber stored on the spool, as stated with respect to FIG. 2.

Figure 4:
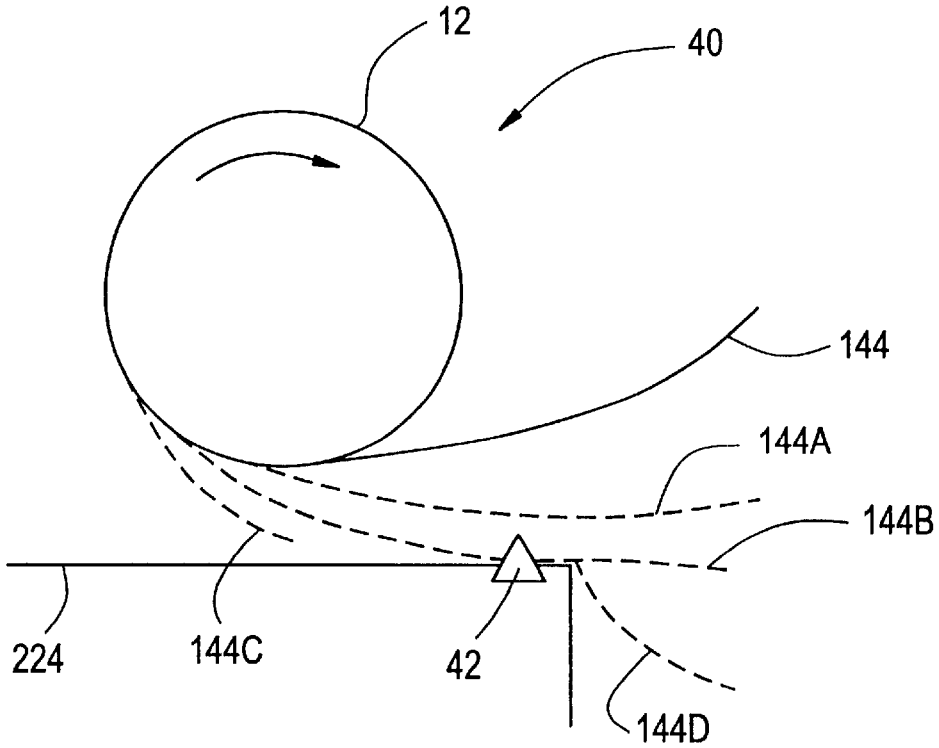
FIGS. 4 and 5 are schematic views of apparatuses that may be used to practice the invention.

An exemplary embodiment of the present invention is shown in FIG. 4. An optical waveguide whipping end cutting apparatus is designated generally by reference numeral 40. The apparatus 40 includes an active cutting element 42. The active cutting element 42 may be disposed on a surface 224, however, this is not required to practice the invention. The active cutting element 42 will be described in greater detail with respect to FIGS. 6 and 7.

As the fiber 12 rotates, the whipping end 144 of the fiber 12 will engage the cutting element 42. The engagement of the active cutting element 42 and the whipping end 144 will remove a segment of the whipping end 144D which otherwise might be caused to whip into the fiber already stored on the spool.

A residual portion of the whipping end 144C will remain attached to the fiber 12 which is stored on the spool. As the spool continues to rotate, the residual portion 144C will now be too short to come in contact with the vertical portion of surface 224 in a manner to deform the residual whipping end 144.

Nor is the whipping end 144C of sufficient length or mass to cause the whip damage to fiber 12 that could be caused by whipping end 144. This process is generally designated by reference numerals 144A–144D. The cutting element 42 is disposed in relation to fiber 12 to minimize continuous whip damage to the wound fiber 12.

If the fiber 12 wound the spool were to unravel from the spool during rotation, the cutting element 42 is disposed to remove the unraveled fiber similar to the removal of the segment 144D.

Figure 5:
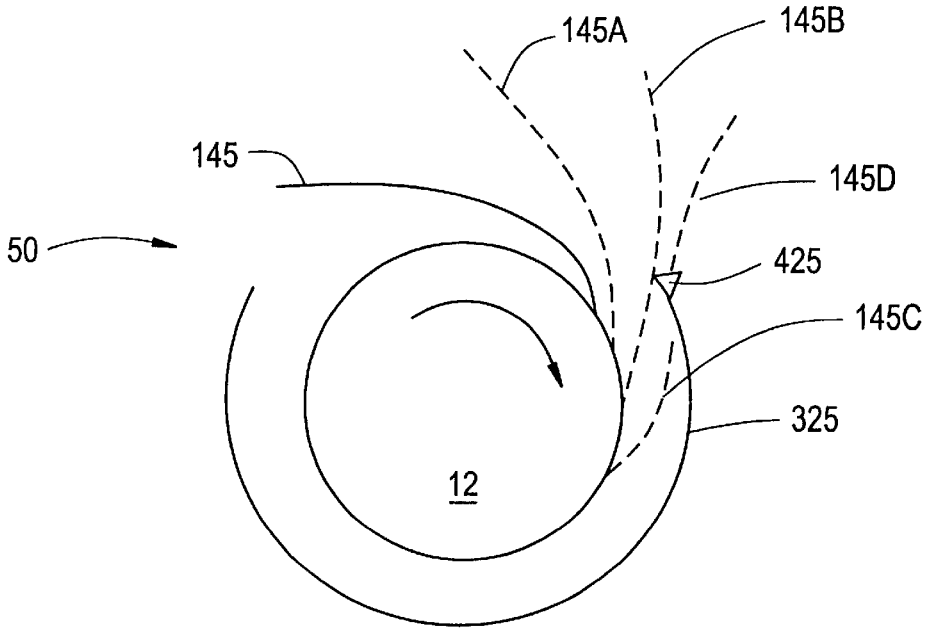
Figure 8:
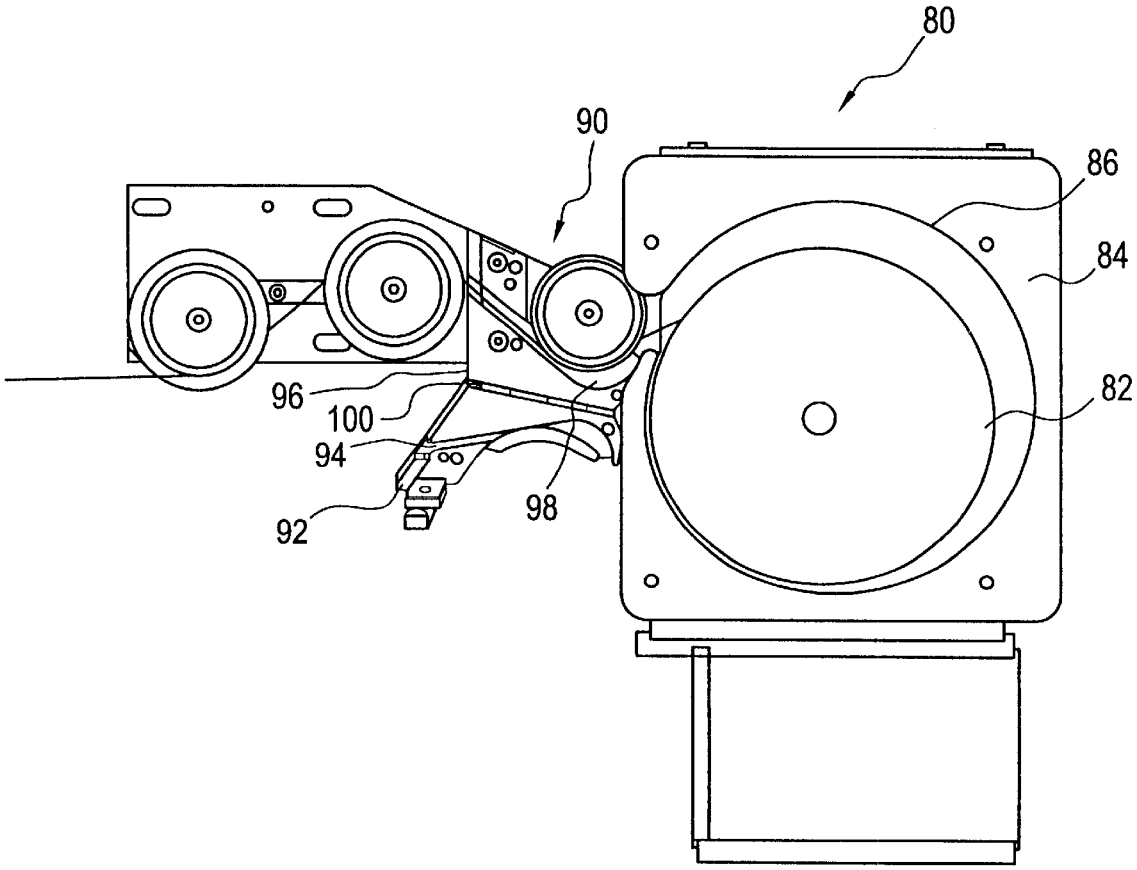
FIG. 8 is side elevation view of a fiber guide and a channel arrangement according to the present invention.

In FIG. 5, an active cutting element 425 is shown in combination with a guide/guard 325, generally designated by reference numeral 50. The cutting element 425 is disposed on the guide 325 such that the whipping end 145 of the fiber 12 will not come in contact with guide 325 in a manner to deform the whipping end 145. Instead, as designated by reference numerals 145A–145C, the whipping end 145 will engage the cutting element 425 such that a segment 145D is removed from the whipping end 145 and a residual portion 145C will remain attached to the fiber 12. Residual portion 145C is similar to the residual portion 144C of FIG. 4. No particular shape is required for the guide 325. One suitable shape for guide 325 is circular. Another suitable shape is a noncircular guide. A noncircular guide has the advantage of being able to manipulate the trajectory of the whipping end. A fiber guide 80 and channel are illustrated in FIG. 8. Fiber guide 80 includes a spool 82 which optical fiber is being wound onto Spool 82 is disposed in a housing 84, which includes a noncircular fiber guide 86. Also illustrated in FIG. 8 is a channel element 90. Element 90 includes plates 92 and 96. Each plate includes a groove 94, 98. When the plates 92 and 96 are adjoined, grooves 94 and 98 form a channel for the fiber to travel into guide 80. Optionally, plates 92 and 96 can be joined by a hinge mechanism 100. Channel element 90 and fiber guide 80 is further explained in U.S. Pat. No. 5,964,431 and U.S. patent application Ser. No. 09/090748 which were previously incorporated into the application by reference. whipping end 145. Instead, as designated by reference numerals 145A–145C, the whipping end 145 will engage the cutting element 425 such that a segment 145D is removed from the whipping end 145 and a residual portion 145C will remain attached to the fiber 12. Residual portion 145C is similar to the residual portion 144C of FIG. 4. No particular shape is required for the guide 325. One suitable shape for guide 325 is circular. Another suitable shape is a noncircular guide. A noncircular guide has the advantage of being able to manipulate the trajectory of the whipping end.

The active cutting element 42 or 425 may be attached to the respective surface 224 or guide 325 by any known technique. The invention is not limited with respect to how the cutting element may be attached to a surface or a guide.

Figure 6:
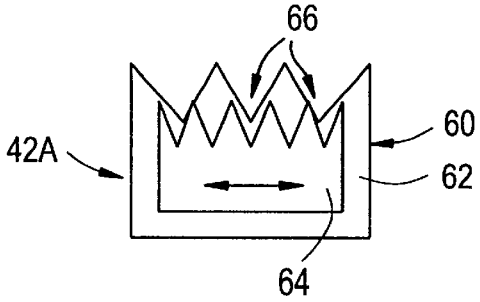
FIGS. 6 and 7 are schematic views of active cutting elements.
Figure 7:
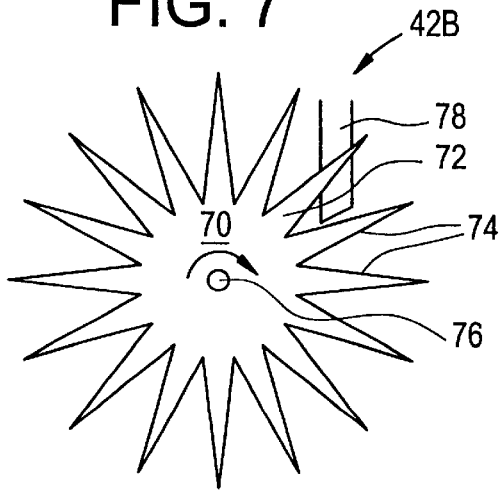

Shown in FIGS. 6 and 7 are representative embodiments of the cutting element 42. Illustrated in FIGS. 6 and 7 are active cutting elements, meaning that they are comprised of a dynamic or moving element. Each cutting element 42 provides the necessary force to cut the fiber 12. Each cutting element 42 may also be used to cut a stationary fiber 12.

As shown in FIG. 6, an embodiment of the cutting element 42A is generally designated 60. The embodiment in FIG. 6 includes a stationary element 62 and an oscillating element 64. The elements 62 and 64 are disposed such that a cutting surface 66 is formed. The surface 66 is formed by the element 62 retaining the fiber at a reference point and element 64 oscillating back and forth to provide the shear force to cut the whipping end of the fiber. Element 64 may be also referred to as a first cutting surface which is adjacent to and oscillates with respect to element 62. The element 62 may also be referred to as a second cutting surface. A channel (not shown) may be used to direct the fiber into and across the surface 66.

FIG. 7 is an additional embodiment of cutting element 42B, designated as 70. The cutting element 70 includes a hub 72 having a plurality cutting arms 74 extending from the hub 72. The cutting element 70 may be attached to a suitable driving mechanism, for example via aperture 76, for rotating the cutting element 70. As the cutting element 70 rotates, the plurality of arms 74 will engage the whipping end of a fiber and remove a segment of the whipping end. Optional, the element 70 may have a surface 78. The surface 78 is preferably stationary similar to element 62 of FIG. 6. The surface 78 will retain the fiber for arms 74 to engage the fiber. The surface 78 is most useful when the element 70 is rotating at slower speeds. When the cutting element 70 rotates at a slow enough speed, the stiffness and inertia of the fiber will not keep the fiber in place for the cutting element 70 to cut the whipping end from the fiber. In this instance, the surface 78 will maintain the fiber in place for the cutting element 70 to engage the fiber and remove the whipping end.

The invention is not limited to the two embodiments of the cutting element 42 shown in FIGS. 6 and 7.

The invention also includes a method of cutting the whipping end 14 from the fiber 12. As previously indicated, the method includes removing a segment of the whipping end 14 from fiber 12 being wound onto the spool. An additional optional step may include winding the fiber 12 on a spool prior to removing the segment of the whipping end 14. The methods disclosed herein are extremely useful in preventing continuous whip damage to a wound segment of the fiber 12.

In an alternate embodiment, the method may include the fiber contacting a benign surface after the cutting element engages the fiber. Such a benign surface may include a smooth inside surface of the guide 325, as shown in FIG. 5.

The invention also includes a method of cutting the fiber 12 during the winding of the fiber 12 onto a storage spool, in the case of a fiber break. The method includes separating the whipping end 14 of the fiber 12 from a wound segment of the fiber 12 with the active cutting element 42. This separating may be accomplished by engaging a cutting surface of the element 42 with the fiber 12.

The invention also includes a method of reducing whip damage to a fiber being wound on a spool. The method includes engaging the active cutting element 42 on a surface of the fiber being wound on a spool, and removing a loose end from the fiber. The method may also include disposing a guide around the spool or a channel to guide the whipping end 14 into contact with the cutting element 42.

It will be apparent to those skilled in the art that various modifications and variations can be made to the present invention without departing from the spirit and scope of the invention. Thus, it is intended that the present invention covers the modifications and variations of this invention provided they come within the scope of the appended claims and their equivalents.

What is claimed is:

1. An optical fiber cutting apparatus comprising an active cutting element which is positioned to cut a segment from an end of an optical fiber, while the fiber is wound onto a rotating spool, and thereby prevent fiber whip.

2. The apparatus of claim 1 wherein said element includes a rotatable hub having a plurality of cutting arms extending from said hub.

3. The apparatus of claim 2 further comprising a surface to retain the fiber for engagement by said arms.

4. The apparatus of claim 1 wherein said element includes a first cutting surface which is adjacent to and oscillates with respect to a second cutting surface.

5. The apparatus of claim 4 wherein the second cutting surface is stationary.

6. The apparatus of claim 1 further comprising a surface positioned to guide said fiber after said cutting element cuts said segment from said fiber.

7. The apparatus of claim 6 wherein said surface is a fiber guide.

8. The apparatus of claim 7 wherein said fiber guide is circular.

9. The apparatus of claim 7 wherein said fiber guide is noncircular.

10. The apparatus of claim 1 further comprising a channel to direct said segment toward said element.

11. The apparatus of claim 1 wherein said segment is a whipping end.

12. A method of cutting a whipping end from an optical fiber, said method comprising removing a segment of the end of the fiber with an active cutting element and, prior to said removing, winding the fiber on a spool, said cutting element is positioned to cut said fiber and thereby prevent whip damage to the fiber wound on the spool.

13. The method of claim 12 wherein said removing includes a cutting surface of the element moving into a surface of the fiber.

14. The method of claim 12 wherein the fiber is in contact with a guide surface after said removing.

15. A method of cutting an optical fiber while winding the fiber onto a storage spool, the fiber having a whipping end and a wound segment, said method comprising:

separating the whipping end of the fiber from the wound segment with an active cutting element.

16. The method of claim 15 wherein said separating is accomplished by engaging a cutting surface of the element with the fiber.

17. An optical fiber cutting apparatus comprising:

an optical fiber, having an end, being wound onto a rotating spool; and an active cutting element positioned nearby the spool to cut a segment from said end to thereby prevent fiber whip.

18. A method of cutting a whipping end from an optical fiber, said method comprising:

removing a segment of the whipping end of the fiber with an active cutting element and, prior to said removing, winding the fiber on a spool.

* * * * *